United States Patent [19]

Åslin

[11] 4,260,083

[45] Apr. 7, 1981

[54] PULL-ON DEVICE FOR STOCKINGS

[76] Inventor: Nils O. G. Åslin, Akergränd –, 85247 Sundsvall, Sweden

[21] Appl. No.: 967,728

[22] Filed: Dec. 8, 1978

[30] Foreign Application Priority Data

Dec. 14, 1977 [SE] Sweden ..... 7714228

[51] Int. Cl.[3] ..... A47J 51/06

[52] U.S. Cl. ..... 223/111

[58] Field of Search ..... 223/111, 112, 113, 114

[56] References Cited

U.S. PATENT DOCUMENTS

| | | | |
|---|---|---|---|
| 2,828,057 | 3/1958 | MacLauchlan | 223/111 |
| 3,310,209 | 3/1967 | Clauss | 223/111 |
| 3,401,856 | 9/1968 | Berlin | 223/111 |
| 3,452,907 | 7/1969 | MacLauchlan | 223/111 |
| 3,853,252 | 12/1974 | Scianimanico | 223/111 |

*Primary Examiner*—Louis Rimrodt

*Attorney, Agent, or Firm*—Birch, Stewart, Kolasch & Birch

[57] ABSTRACT

A pull-on device is disclosed which makes it easier for persons handicapped in their ability of move to put on stockings. The novel pull-on device comprises a stocking-foot resembling piece (10) made of soft material and cut open on the top side. The sole of the piece is devised to be stiff in the longitudinal direction and resilient along a middle portion. The middle portion is connected at the heel part with a rearwards protruding plate member (14) of flexible material and a forward projecting sheet member under the sole (16). The side portions formed by the cut are devised to keep facing one another so as together with the sole between themselves to define an expansible space suited for insertion of a foot the side portions are capable of surrounding a stocking applied thereon. In addition, the pulling means (26, 28) are attached to the rear edges of the piece (10) and the plate member (14) to render possible with assistance of the flexible plate member (14) gradual insertion and advance of the foot to the toe portion of the stocking the subsequent pulling on of the stocking and removal of the piece (10) with plate member (14) and sheet member (16) attached thereto is accomplished by separating the side portions from each other after the user finishes pulling-on of the stocking.

11 Claims, 8 Drawing Figures

PULL-ON DEVICE FOR STOCKINGS

This invention relates to a pull-on device for stockings.

Various designs of devices for putting on stockings are known and devised to help disabled persons suffering from various handicaps in their ability of move. There exist staff-shaped devices which are provided with hoops or sleeve-like members of varying shape and which usually are made of metal or other stiff material. There exist also devices which are made of soft material. The first-mentioned devices have a low friction coefficient and, therefore, a stocking easily slips off before it has reached correct position. Devices of the last-mentioned type are not so common and the pull-on devices of this kind which now exist require great user mobility. Therefore, the field of use of these pull-on devices for stockings is very limited, and for one-armed persons and persons suffering from hard articular troubles in legs and feet no suitable pull-on devices for stockings have been available hitherto.

The afore-stated short-comings of the known devices for pulling on stockings are eliminated by the device constructed according to the present invention. This device is an implement for pulling on stockings which can be used by persons suffering from the above-stated handicaps in movability and, therefore, the present device is more usable generally than previously known designs. The employed material results in eliminating the risk of the stocking slipping off. The whole device except enclosed springs is made of soft or flexible material which even when the user is fumbling cannot cause damage to clothing, skin or other things. In addition, the costs of production are low.

The novel pull-on device for stockings has the characteristic features stated in the accompanying claims and will now be described in more detail in the shape of several preferred embodiments with reference to the attached drawings.

Figure 1:
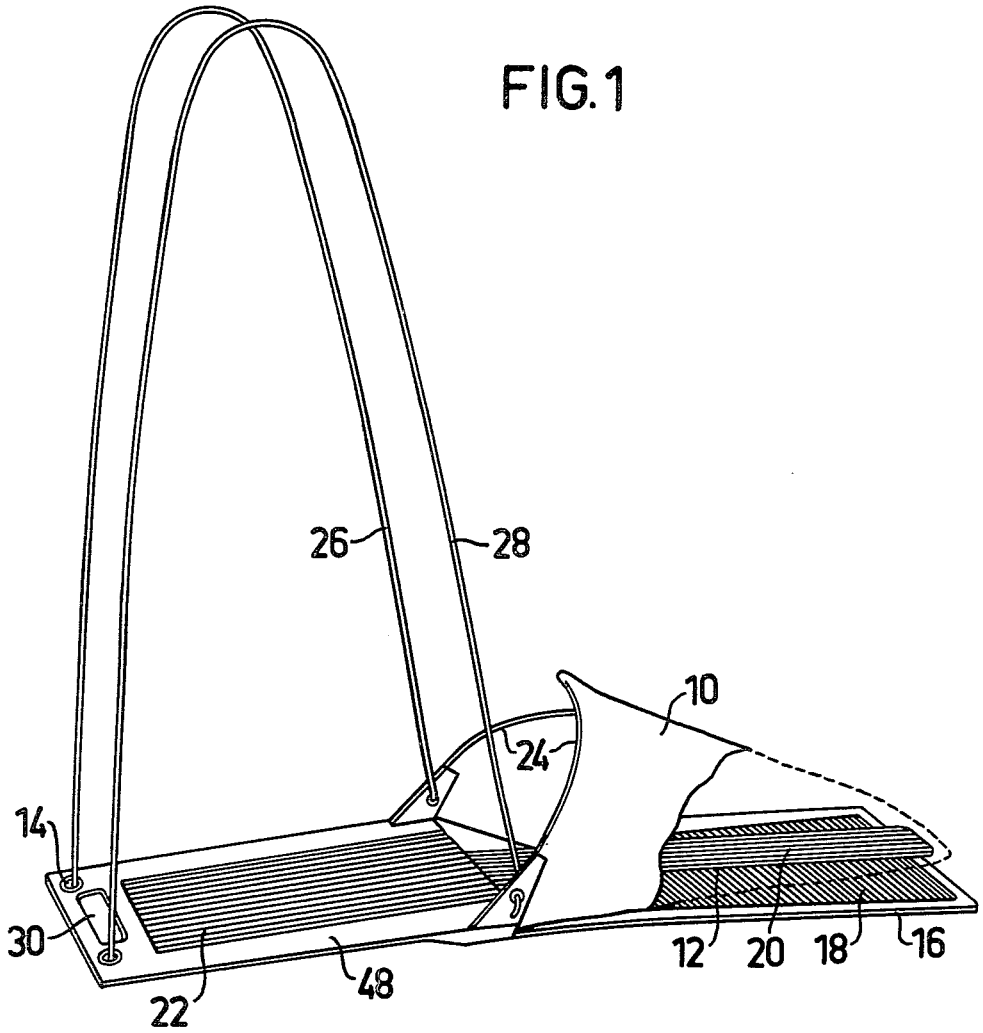
FIG. 1 is a perspective and partially opened view of a first embodiment of the novel pull-on device for stockings.

In the embodiment shown in FIG. 1, the pull-on device for stockings consists mainly of a piece 10 of textile fabric which resembles the foot of a stocking, but is cut up longitudinally on the top side. The sole portion of said piece comprises a thin, substantially stiff, strip 12 which at the edge portion facing the heel is connected with an elongated plate member 14 extending rearwards and made of some flexible material. Projecting from the heel edge of strip 12 towards the toe portion below the strip is a sheet member 16 intended to prevent a stocking applied onto the stocking-foot resembling piece 10 from getting caught or slipping off from the piece 10 on frictional contact with a floor or the like. The sheet member 16 is formed with transversally extending ribs 18 which assist in retaining the stocking on the piece 10. Both the strip 12 and the elongated plate member 14 are formed with longitudinal ribs 20 and 22, respectively, which are intended to render easier the sliding advance of the foot into the stocking foot resembling piece 10.

The side portions of the piece 10 formed by the longitudinal cut are kept facing one another with some overlapping by means of spring members 24 inserted into the side portions so as to follow the outer edges thereof and between themselves and the sole strip 12 to define a space expansible against the action of said spring members and adapted to allow introduction of the foot. Secured to the rear edges of the piece 10 and the plate member 14 are two cords 26 and 28 which serve as pulling means when applying the stocking. In addition, the rear edge portion of the plate member 14 has a rectangular aperture 30 which permits the plate member 14 also to be used as pulling means in the final stage of the operation to pull on the stocking.

Figure 2:
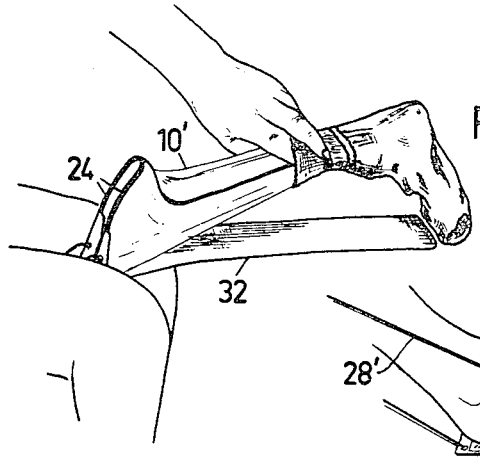
FIGS. 2 through 7 are perspective views of a second embodiment of the novel pull-on device for stockings representing various steps of a pulling-on operation.
Figure 3:
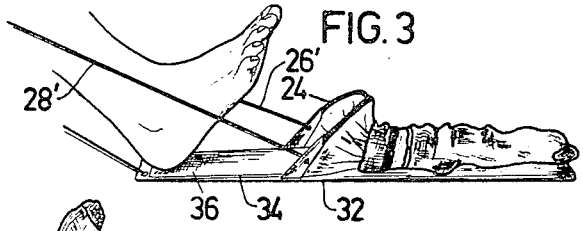
Figure 4:
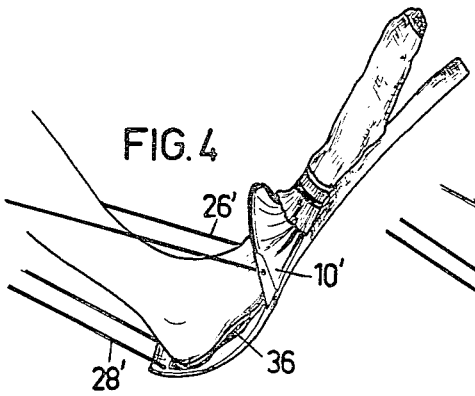
Figure 5:
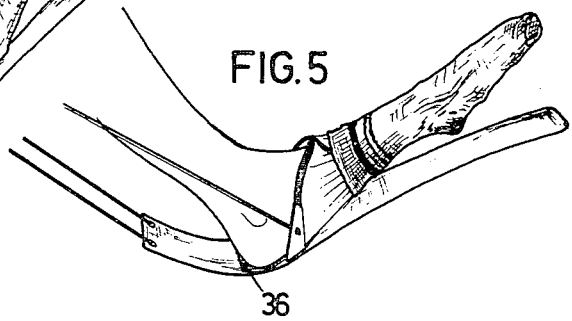
Figure 6:
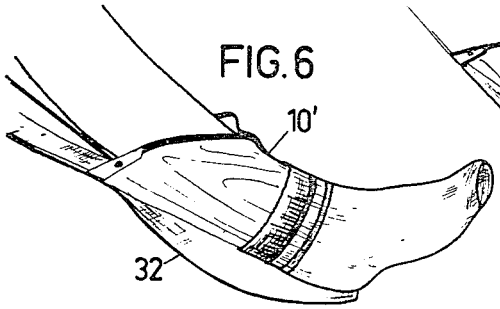
Figure 7:
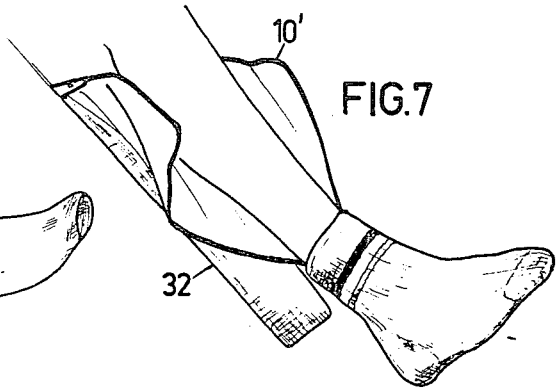

A person having one arm only and a stiff ankle can pull on a stocking in the manner illustrated in the FIGS. 2 through 7. In this case, the embodiment of the device to be used has the elongated plate member 14 and the sheet piece 16 represented in FIG. 1 formed as a single element 32, a separate sheet element 34 of flexible material being secured to the rear edge of the element 32 and projecting over the rear edge of the thin strip 12. Fastened to the front edge of the sheet element 34 is a piece 36 of a fabric which promotes the sliding advance movement of the foot and which is folded over said edge and covers the main portion of the top side of the sheet element 34. In the first step of the operation to apply the stocking the pull-on device is retained between the knees while a stocking is pushed onto the stocking-foot resembling piece 10' and the sole thereof, which by the strip 12 is kept stretched and thereby renders possible to draw the stocking onto the piece 10' (FIG. 2). When this applying step is finished, the pull-on device is placed in front of the foot which thereupon is positioned upon the rear portion of the element 32 (FIG. 3) on the top surface of the fabric piece 36. Even when the ankle is stiff it is easily possible to advance the foot into the stocking foot resembling piece 10' irrespective of whether the user sits on a stool or in a bed. By applying a tractive force to the front portions of the two cords 26', 28', the user causes the front portion of the element 32 together with the sole and the piece 10' to be bent upwards so that the foot now is directed towards the arched space between the side portions of the piece 10 (FIG. 4). By further pulling both portions of the two cords 26', 28' the rear portion of the sheet element 34 is caused to establish contact with the heel of the foot and the foot is caused to slide further on the piece of fabric 34 into the piece 10' so as to advance into the toe portion of the stocking (FIG. 5). By continuing the pulling operation by drawing the cords the pull-on device is moved upwards along the leg and due to the friction between the piece 10' and the stocking the latter is plained, the part of the element 32 positioned between the stocking and the support preventing the stocking from sliding off (FIG. 6). On continued pulling, the piece 10' opens wholly after having left the stocking in perfect position on the foot and the leg without necessitating any further adjustment.

Figure 8:
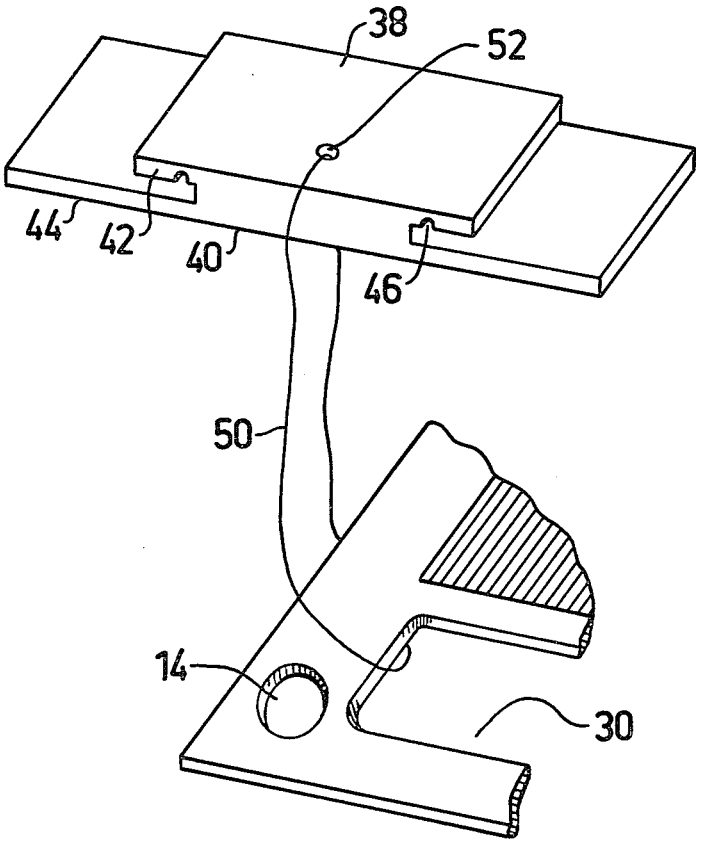
FIG. 8 is a perspective view of an additional element belonging to the novel pull-on device to adapt it to put on tights.

It is also possible to supplement the pull-on device described hereinbefore so as to become suited for the putting-on of tights. In this case two pull-on devices are used together with a supplemental element of the type shown in FIG. 8. The supplemental element comprises two sheet parts 38, 40 piled in parallel the one upon the other and united with each other by a common central portion, the end portions 42, 44 being spaced from each other by a gap the width of which fits to the thickness of the elongated plate member 14 shown in FIG. 1. The lower sheet portion 40 protrudes over an upper sheet portion 38. This facilitates the correct insertion of a pull-on device for stockings between the ends of the associated sheet member portions. To ensure good fixation of the pull-on device a groove 46 is formed on the underside of the upper sheet portion 38 adjacent the inner edge thereof along the central portion of supplemental element. A ridge 48 fitting to the groove extends along the corresponding lateral edge of the elongated plate member 14. The supplemental device is attached to a stockings pull-on device by a string 50 which extends through a hole 52 in the element and the aperture 30 in the plate member 14.

Within the scope of the accompanying claims, the invention can be varied in various details without departing from the basic inventive idea. Thus, it may be suitable, for example, to design the pull-on device collapsible along the concave edge portion of the stocking-foot resembling piece in order thereby to save storage space.

I claim:

1. A device for pulling stockings onto a user's foot comprising:

a stocking-foot resembling piece for holding the stocking to be applied, said stocking-foot resembling piece being made of substantially soft material and having a toe portion and an open portion, said stocking-foot resembling piece being cut open along the top side in the longitudinal direction and having a stiff and resilient central sole portion;

a protruding plate means connected to the open portion of said stocking-foot resembling piece, said protruding plate means being at least partially made of a flexible material and extending forward beneath said stocking-foot resembling piece and rearwards from the open portion of said stocking-foot resembling piece;

and means for pulling the stocking onto a foot by pulling the stocking-foot resembling piece along the foot.

2. The pull-on device as claimed in claim 1, wherein said stocking-foot resembling piece is made of textile fabric or similar material with springs inserted along the edges of said open portion and said central sole portion is an elongated strip of resilient plate-like material located in the sole extending from the open portion to the toe portion.

3. The pull-on device for stockings as claimed in claim 1 or 2, wherein said means for pulling is a pair of cords, each attached with one end at the side portion of said open portion of the stocking-foot resembling piece and with the other end at the rear edge of the protruding plate means.

4. The pull-on device for stockings as claimed in claim 3, further comprising a piece of soft material secured to or adjacent to the rear edge of said resilient central sole portion and capable of projecting to the rear edge of the flexible plate member.

5. The pull-on device for stockings as claimed in claim 4, wherein the piece of soft material is secured to the underside of the front edge of said flexible plate member and folded over said edge.

6. The device of claim 1 wherein the stocking is positioned inside the open portion of said stocking-foot resembling piece and the means for pulling is used to pull the stocking onto the foot by pulling the foot through the said stocking-foot resembling piece.

7. The device of claim 6 wherein the foot is placed on said protruding plate means and said protruding plate means is used to guide said stocking-foot resembling piece onto the foot.

8. The pull-on device for stockings as claimed in claim 6 wherein the toe of said plate member and said central sole are formed with longitudinally extending ribs.

9. The pull-on device for stockings as claimed in claim 8, wherein said sheet member is formed with transversally extending ribs.

10. The device according to claim 1 wherein said protruding plate means comprises:

an elongated flexible plate member extending rearward from said open portion of said stocking-foot resembling piece; and a sheet member extending forward beneath said stocking-foot resembling piece.

11. The pull-on device for stockings as claimed in any of claims 6–10 wherein said flexible plate member is secured to the rear edge of the sheet member and positioned to cover the rear edge of said resilient central sole portion.

* * * * *